US010039373B2

(12) United States Patent
Choi

(10) Patent No.: US 10,039,373 B2
(45) Date of Patent: Aug. 7, 2018

(54) HEIGHT ADJUSTMENT DEVICE FOR FOLDING TABLE AND FOLDING TABLE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 15/695,303

(22) Filed: Sep. 5, 2017

(65) Prior Publication Data

US 2018/0192768 A1 Jul. 12, 2018

(51) Int. Cl.

| | |
|---|---|
| ***A47B 9/00*** | (2006.01) |
| ***A47B 9/16*** | (2006.01) |
| ***A47B 13/02*** | (2006.01) |
| *A47B 3/02* | (2006.01) |

(52) U.S. Cl.

CPC ..... *A47B 9/16* (2013.01); *A47B 13/02* (2013.01); *A47B 2003/025* (2013.01)

(58) Field of Classification Search

CPC ..... A47B 9/16; A47B 3/0809; A47B 3/0818; A47B 13/02; A47B 21/02

See application file for complete search history.

(56) References Cited

U.S. PATENT DOCUMENTS

| | | | | |
|---|---|---|---|---|
| 2,023,870 | A | 12/1935 | Casott | |
| 2,713,529 | A | 7/1955 | William | |
| 3,884,159 | A | 5/1975 | Faria | |
| 4,341,164 | A | 7/1982 | Johnson | |
| 5,890,437 | A | 4/1999 | Hill | |
| 6,125,769 | A | 10/2000 | Tsai | |
| 6,401,630 | B1 | 6/2002 | Peterson | |
| 6,619,601 | B1 | 9/2003 | Vali | |
| 7,644,665 | B2 | 1/2010 | Creighton | |
| 9,326,598 | B1 * | 5/2016 | West | A47B 3/02 |
| 2003/0233966 | A1 | 12/2003 | Zheng | |
| 2004/0250739 | A1 | 12/2004 | Yang | |
| 2007/0209559 | A1 * | 9/2007 | Mockel | A47B 3/0803 108/115 |
| 2010/0258042 | A1 * | 10/2010 | Rutz | A47B 3/0818 108/115 |
| 2016/0249737 | A1 * | 9/2016 | Han | B60P 3/34 108/145 |
| 2016/0309888 | A1 * | 10/2016 | Krusin | A47B 3/0809 |
| 2018/0055214 | A1 * | 3/2018 | Kim | A47B 9/16 |
| 2018/0090915 | A1 * | 3/2018 | Byrne | H02B 1/06 |

FOREIGN PATENT DOCUMENTS

| | | | |
|---|---|---|---|
| DE | 102006024602 | A1 | 11/2007 |
| JP | 7-275042 | A | 10/1995 |

* cited by examiner

*Primary Examiner* — Daniel J Rohrhoff

(74) *Attorney, Agent, or Firm* — Morgan, Lewis & Bockius LLP

(57) ABSTRACT

Disclosed are height adjustment devices and folding tables. A height adjustment device includes movably coupled inner and outer sleeves. The inner and outer sleeves are coupled to first and second legs of a table. The height adjustment device also includes an elastic positioning pin and a cord. The elastic positioning pin is disposed on an external side of the outer sleeve to selectively engage with the inner sleeve. The cord is coupled to the elastic positioning pin and configured to pull the elastic positioning pin outward to disengage the elastic positioning pin from the inner and/or outer sleeves.

20 Claims, 7 Drawing Sheets

HEIGHT ADJUSTMENT DEVICE FOR FOLDING TABLE AND FOLDING TABLE HAVING SAME

CROSS-REFERENCE(S) TO RELATED APPLICATIONS

The present application claims priority to Chinese Patent Application No. 201720016965.9, filed on Jan. 9, 2017, the entire contents of which are incorporated herein for all purposes by this reference.

BACKGROUND OF THE INVENTION

Field of the Invention

The present disclosure relates to folding tables. More particularly, the present disclosure relates to height adjustment devices for folding tables and folding tables having such height adjustment devices.

Description of Related Art

In general, as the population continues to expand and living quarters become more compact, articles of daily use must have diversified adjustable functions. Folding tables are essential articles for many households, since folding tables may be manipulated in various methods to optimize available storage volume and convenience to users. Typically, folding tables are utilized in homes, but can also be used outdoors for activities including camping. The service life of a folding table can be attributed to the build quality and range of plausible uses.

Conventional folding tables utilize a height adjustment device in order to provide users with a range of adjustable table top heights. Height adjustment devices are configured to enable a user to quickly change the height of folding tables.

Referring to FIG. 1, a height adjustment device and folding table of the prior art are shown. Conventional folding tables comprise a table top 1' and at least one layer of grouped crossed legs. Each crossed leg group includes two sets of parallel crossed legs 2', which further comprise two crosswise pivoting support rods 21'. Upper end portion of each support rod 21' is coupled to a connection rod 22'. Each of the connection rods 22' is movably coupled to a bottom surface of the table top 1', and an adjustment positioning device is disposed between the two connection rods 22', wherein the adjustment positioning device is capable of adjusting a distance between the two connection rods 22'.

The adjustment positioning device comprises a retractable inner sleeve 31' and a retractable outer sleeve 32'. A stretchable pull rod 33' is disposed on an external side of the inner sleeve 31' and the outer sleeve 32'. When the pull rod 33' is pulled outwardly from the inner sleeve 31' and outer sleeve 32', positioning of the inner sleeve 31' and the outer sleeve 32' can be adjusted.

The connection rod 22' is slidably disposed in a sliding seat 4', which in turn is connected to the bottom surface of the table top 1'. The connection rods 22' slides within the sliding seat 4' according to the movement of the inner sleeve 31' and the outer sleeve 32'. The movement of the connection rods 22' cause a change of an opening angle between the crossed legs 2', thereby realizing a change of the table top 1' height.

For the height adjustment device described above, when the height of the table top 1' needs to be adjusted, pull rod 33' must be drawn outwardly. In the present case, the inner sleeve 31' and the outer sleeve 32' move relative to one another corresponding to the movement of the connection rod 22'; therefore, the pull rod 33' moves according to the movement of the outer sleeve 33' during operation. As such, the pull rod 33' has two degrees of freedom: a first in a latitudinal, inward and outward, direction, and a second in a longitudinal, left and right, direction which corresponds to the movement of the connection rods 22'. A limiting device 332' must be disposed on the bottom surface of the table top 1' in order to properly operate the pull rod 33'. As such, the adjustable range of the height adjustment device is limited and the table top 1' cannot be adjusted freely.

Thus, there remains a need for improved height adjustment devices and folding tables having such height adjustment devices which are more convenient to users during folding and unfolding operations and enable a more diverse and flexible height adjustment range.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Advantageously, the height adjustment devices and folding tables having such height adjustment devices detailed in the present disclosure address the shortcomings in the prior art detailed above.

Various aspects of the present disclosure are directed to providing height adjustment devices for folding tables and folding tables having such height adjustment devices.

One aspect of the present disclosure provides a height adjustment device for a folding table. The folding table comprises a table top, a first leg, and a second leg, wherein the first and second legs are crosswise pivotally connected to each other. Each of the first and second legs comprises a connection rod movably coupled to a bottom surface of the table top.

The height adjustment device comprises an inner sleeve, an outer sleeve, an elastic positioning pin, and a cord. The inner sleeve has a first end portion coupled to the connection rod of the first leg. The inner sleeve comprises a rack disposed on a side of the inner sleeve, wherein the rack further comprises a plurality of engaging slots disposed along a longitudinal direction of the inner sleeve. The outer sleeve is movably coupled to the inner sleeve and has a first end portion coupled to the connection rod of the second leg. The outer sleeve further comprises a first hole on a peripheral wall thereof.

The elastic positioning pin is disposed on an external side of the outer sleeve. The elastic positioning pin is configured to pass through the first hole of the outer sleeve to selectively engage with a respective engaging slot in the plurality of engaging slots of the inner sleeve. As such, the elastic positioning pin restrains the inner and outer sleeves from moving relative to each other.

The cord has a first end portion coupled to a rear end portion of the elastic positioning pin and configured to pull the elastic positioning pin outwardly to disengage the elastic positioning pin from the respective engaging slot, thereby allowing an adjustment of a distance between the connection rods of the first and second legs, and thereby an adjustment of a height of the table top.

In some embodiments, the height adjustment device comprises a handle disposed at a second end portion of the cord. The handle is configured to facilitate easy pulling of the elastic positioning pin, and the handle is movably or removably coupled to the bottom surface of the table top.

In some embodiments, the height adjustment device further comprises a connection sleeve, a first connector, and a reset spring. The connection sleeve is disposed externally on the outer sleeve at a position corresponding to the first hole. The first connector is coupled to, or formed with, the connection sleeve at an external side of the connection sleeve. The first connector comprises a cavity configured to accommodate the elastic positioning pin. The cavity of the first connector is aligned and connected with the first hole of the outer sleeve. The reset spring sleeves the elastic positioning pin and is configured to abut an interior surface of the first connector. When the pulling of the elastic positioning pin is released, the reset spring forces the elastic positioning pin to engage with the respective engaging slot in the plurality of engaging slots.

In some embodiments, the elastic positioning pin comprises a stopper. The stopper is disposed between a front end portion and the rear end portion of the elastic positioning pin and configured to abut the first connector, thereby preventing the rear end portion of the elastic positioning pin from being inserted into the inner sleeve.

In some embodiments, the height adjustment device further comprises a second connector coupled to the first connector at an opposite side of the first connector with respect to the connection sleeve. In such embodiments, the elastic positioning pin further comprises a limiting block at the rear end portion of the elastic positioning pin. The limiting block is disposed within the second connector and coupled to the first end of the cord. The limiting block is configured such that a distance of which the limiting block is to be pulled backwards within the second connector is greater than a length of the front end portion of the elastic positioning pin.

In some embodiments, the cord is made of a material selected from the group comprising metal, rope, and plastic. In some embodiments, the cord is surrounded by a tube.

In some embodiments, the height adjustment device further comprises a connecting seat disposed on the bottom surface of the table top. The connecting seat is configured to accommodate the handle and comprises a chute to guide the handle.

Another aspect of the present disclosure provides a height adjustment device for a folding table, wherein the folding table comprises a table top, a first leg, and a second leg. Each of the first and second legs comprises a connection rod movably coupled to a bottom surface of the table top, and the first and second legs are crosswise pivotally connected to each other.

The height adjustment device comprises an inner sleeve, an outer sleeve, an elastic positioning pin, a cord and a handle. The inner sleeve has a first end portion coupled to the connection rod of the first leg. The inner sleeve comprises a rack disposed on a side of the inner sleeve, and the rack comprises a plurality of engaging slots disposed along a longitudinal direction of the inner sleeve. The outer sleeve is movably coupled to the inner sleeve while having a first end portion coupled to the connection rod of the second leg. The elastic positioning pin is coupled with the outer sleeve and configured to selectively engage with a respective engaging slot in the plurality of engaging slots of the inner sleeve, thereby restraining the inner and outer sleeves from moving relative to each other.

The cord has a first end portion coupled to a rear end portion of the elastic positioning pin and the handle is coupled to a second end portion thereof. The handle is also movably or removably coupled to the bottom surface of the table top. The cord and the handle are configured to allow the elastic positioning pin to be pulled outwardly to disengage the elastic positioning pin from the respective engaging slot, allowing the adjustment of a distance between the connection rods of the first and second legs, and thereby the adjustment of a height of the table top.

Another aspect of the present disclosure provides a folding table. The folding table comprises a table top, a first leg, and a second leg. Each of the first and second legs comprises a connection rod movably coupled to a bottom surface of the table top, and the first and second legs are crosswise pivotally connected to each other.

The folding table further comprises a height adjustment device of the present invention disclosed herein.

In some embodiments, the height adjustment device comprises an inner sleeve, an outer sleeve, an elastic positioning pin, a cord, and a handle. The inner sleeve has a first end portion coupled to the connection rod of the first leg. The inner sleeve comprises a rack disposed on a side of the inner sleeve, wherein the rack comprises a plurality of engaging slots disposed along a longitudinal direction of the inner sleeve. The outer sleeve is movably coupled to the inner sleeve and has a first end portion coupled to the connection rod of the second leg.

The elastic positioning pin is disposed on an external side of the outer sleeve and configured to selectively engage a respective engaging slot in the plurality of engaging slots of the inner sleeve, thereby restraining the inner and outer sleeves from moving relative to each other.

The cord has a first end portion coupled to a rear end portion of the elastic positioning pin and the handle coupled to a second end portion thereof. The handle is movably or removably coupled to the bottom surface of the table top, such that the cord and the handle allow for pulling of the elastic positioning pin outwardly, thereby disengaging the elastic positioning pin from the respective engaging slot. Consequently, it allows adjusting a distance between the connection rods of the first and second legs, thereby adjusting a height of the table top.

In some embodiments, the outer sleeve comprises a first hole on a peripheral wall thereof. The elastic positioning pin is configured to pass through the first hole of the outer sleeve to selectively engage with the respective engaging slot in the plurality of engaging slots of the inner sleeve.

In some embodiments, the height adjustment device further comprises a connection sleeve, a first connector, a reset spring. The connection sleeve is disposed externally on the outer sleeve at a position corresponding to the first hole. The first connector is coupled to, or formed with, the connection sleeve at an external side of the connection sleeve. The first connector comprises a cavity configured to accommodate the elastic positioning pin, such that the cavity of the first connector is aligned and connected with the first hole of the outer sleeve. The reset spring sleeves the elastic positioning pin and is configured to abut an interior surface of the first connector, such that when the pulling of the elastic positioning pin is released, the reset spring forces the elastic positioning pin to engage the respective engaging slot in the plurality of engaging slots.

In some embodiments, a stopper is disposed between a front end portion and the rear end portion of the elastic positioning pin. The stopper is configured to abut the first connector, thereby preventing the rear end portion of the elastic positioning pin from being inserted into the inner sleeve.

In some embodiments, a second connector is coupled to the first connector at an opposite side of the first connector with respect to the connection sleeve. The elastic positioning pin further comprises a limiting block at the rear end portion of the elastic positioning pin, such that the limiting block is disposed in the second connector and coupled to the first end of the cord. The limiting block is configured such that a distance of which the limiting block is to be pulled backwards within the second connector is greater than a length of the front end portion of the elastic positioning pin.

In some embodiments, a connecting seat is disposed on the bottom surface of the table top and configured to accommodate the handle, wherein the connecting seat comprises a chute configured to guide the handle.

In some embodiments, each of the first and second legs comprises a first support rod and a second support rod parallel to the first support rod.

In some embodiments, each of the first and second legs further comprises a cross rod coupled to each of the first and second support rods, wherein the cross rods abut a ground when the folding table is unfolded, thereby supporting the folding table.

In some embodiments, a sliding seat is disposed on the bottom surface of the table top. The sliding seat couples an end portion of the connection rod to the bottom surface of the table top, so that the end portion of the connection rod is slidable within the sliding seat. In some embodiments, the sliding seat is integrally formed with the bottom surface of the table top.

In some embodiments, an auxiliary support rod is disposed between a respective leg of the first and second legs and the bottom surface of the table top. A first end of auxiliary support rod is pivotally coupled to the respective leg and a second end of the auxiliary support rod is pivotally coupled to a connection member disposed on the bottom surface of the table top.

The height adjustment devices and folding tables of the present invention have other features and advantages that will be apparent from, or are set forth in more detail in, the accompanying drawings, which are incorporated herein, and the following Detailed Description, which together serve to explain certain principles of exemplary embodiments of the present invention.

Figure 1:
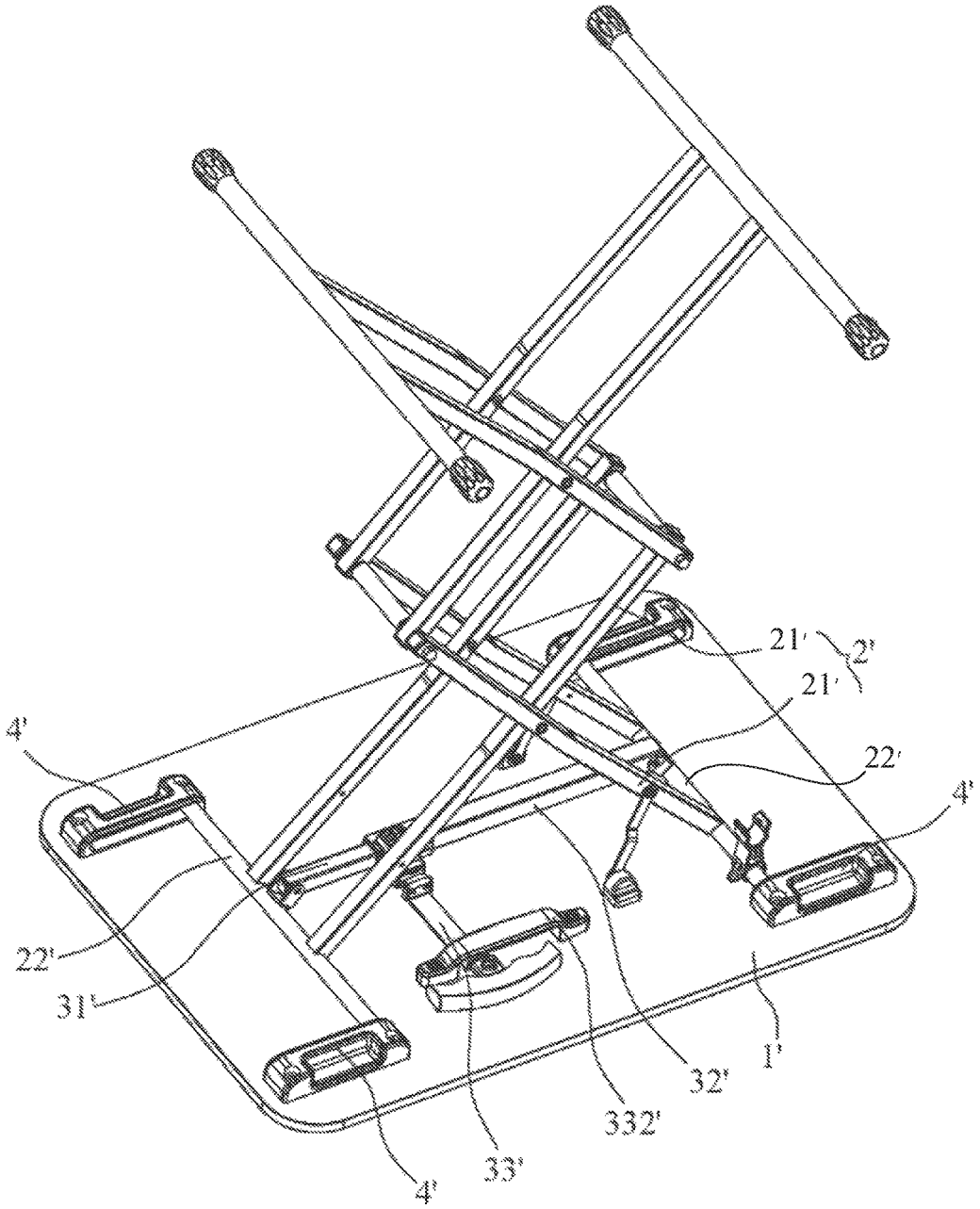
PRIOR ART FIG. 1
FIG. 1 is a view of a folding table according to the prior art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Various aspects of the present disclosure are directed to provide height adjustment devices for folding tables and folding tables having such height adjustment devices.

Referring now to FIGS. 2 and 4-6, in some embodiments, a folding table comprises a table top 1, a first leg 2, and a second leg 2. The first and second legs 2 are crosswise pivotally connected to each other. Each of the first and second legs 2 comprises a connection rod 22 movably coupled to a bottom surface of the table top 1.

In many embodiments, each of the first and second legs 2 comprises one or more support rods coupled to each other. For instance, in the illustrated embodiments, each of the first and second legs 2 comprises a first support rod 21 and a second support rod 21 parallel to the first support rod 21. In some embodiments, each of the first and second legs 2 further comprise a cross rod 23 coupled to each of the first and second support rods 21 so that when the folding table is unfolded and/or in use, the cross rods 23 abut a ground, and support the folding table.

In some embodiments, a sliding seat 6 is disposed on the bottom surface of the table top 1. The sliding seat 6 couples an end portion of the connection rod 22 to the bottom surface of the table top 1, such that the end portion of the connection rod 22 is slidable within the sliding seat 6. In an embodiment, the sliding seat 6 is formed with a chute 61 to accommodate the end portion of the connection rod 22. In some embodiments, the sliding seat 6 is integrally formed with the bottom surface of the table top 1.

In some embodiments, an auxiliary support rod 24 is disposed between the first leg 2 and the bottom surface of the table top 1 or between the second leg 2 and the bottom surface of the table top 1. A first end of auxiliary support rod 24 is pivotally coupled to the respective leg 2 and a second end of the auxiliary support rod 24 is pivotally coupled to the bottom surface of the table top 1. In an embodiment, the second end of the auxiliary support rod 24 is pivotally coupled to a connection member disposed on the bottom surface of the table top 1.

In various embodiments, the folding table further comprises a height adjustment device to adjust the height of the table top. The height adjustment device of the present invention in general comprises an inner sleeve and an outer sleeve movably coupled to each other. The height adjustment device also comprises a positioning pin to selectively engage the inner and outer sleeves, restraining the inner and outer sleeves from moving relative to each other and thus affixing the table at a desired height. In many embodiments, the height adjustment device further comprises a means to disengage the positioning pin, allowing the inner and outer sleeves to move relative to each other and thus the adjustment of the table top to a wide range of heights. In some embodiments, the means to disengage the positioning pin comprises one or more of a cord, a handle, or the like.

Figure 2:
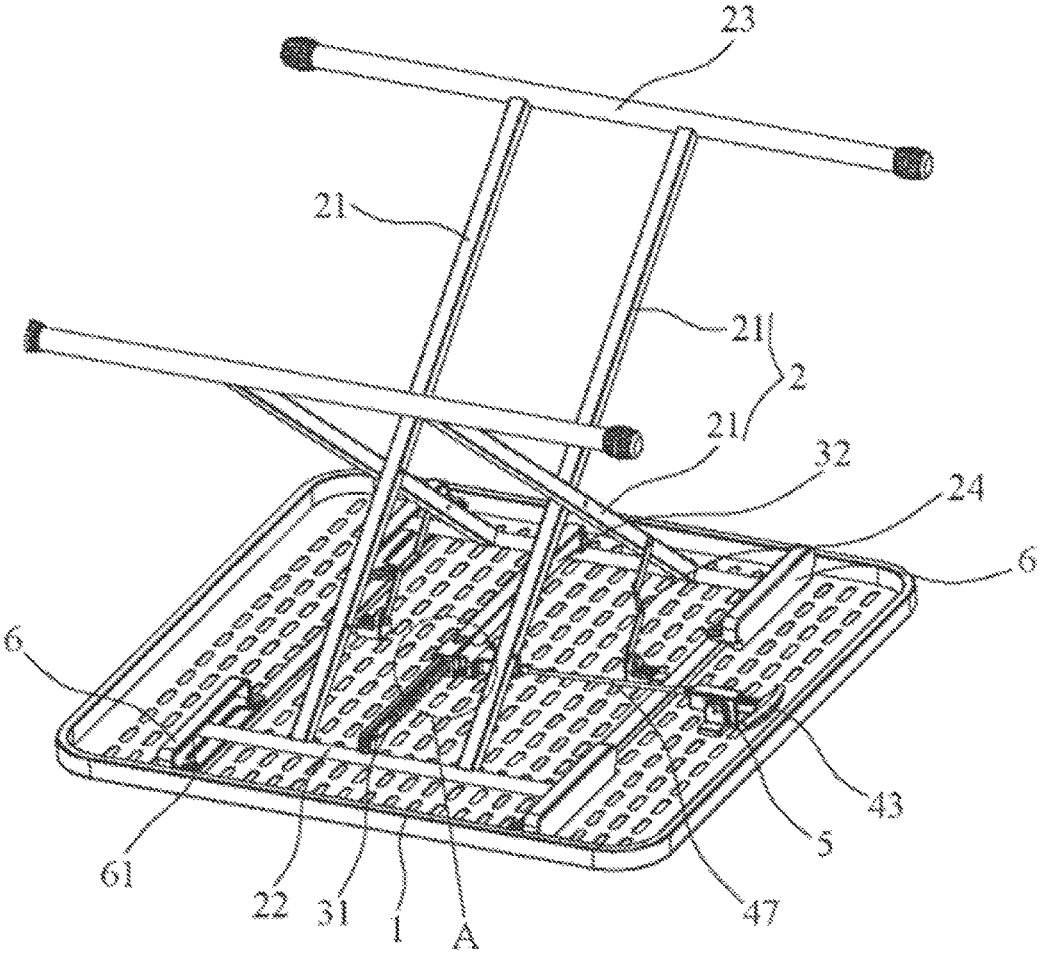
FIG. 2 is a schematic view of a folding table according to an exemplary embodiment of the present disclosure.
Figure 2A:
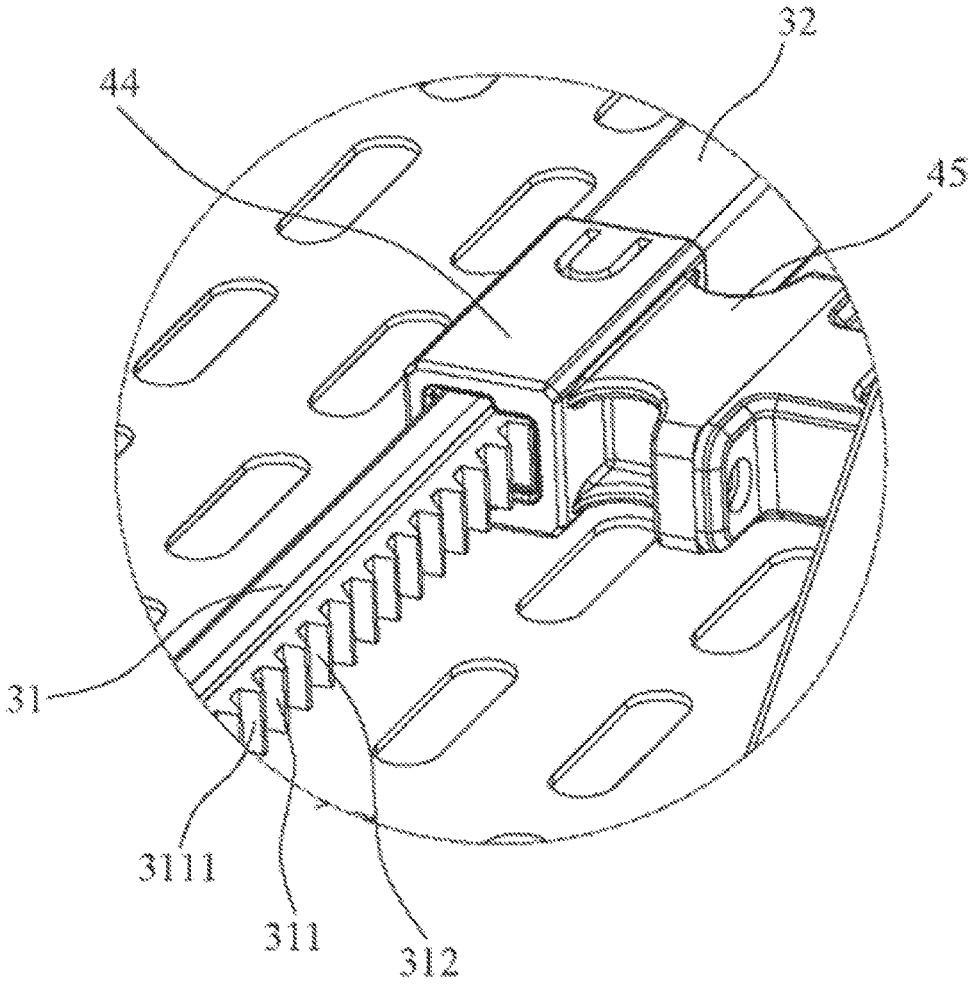
FIG. 2A is an enlarged view of region A in FIG. 2.
Figure 3:
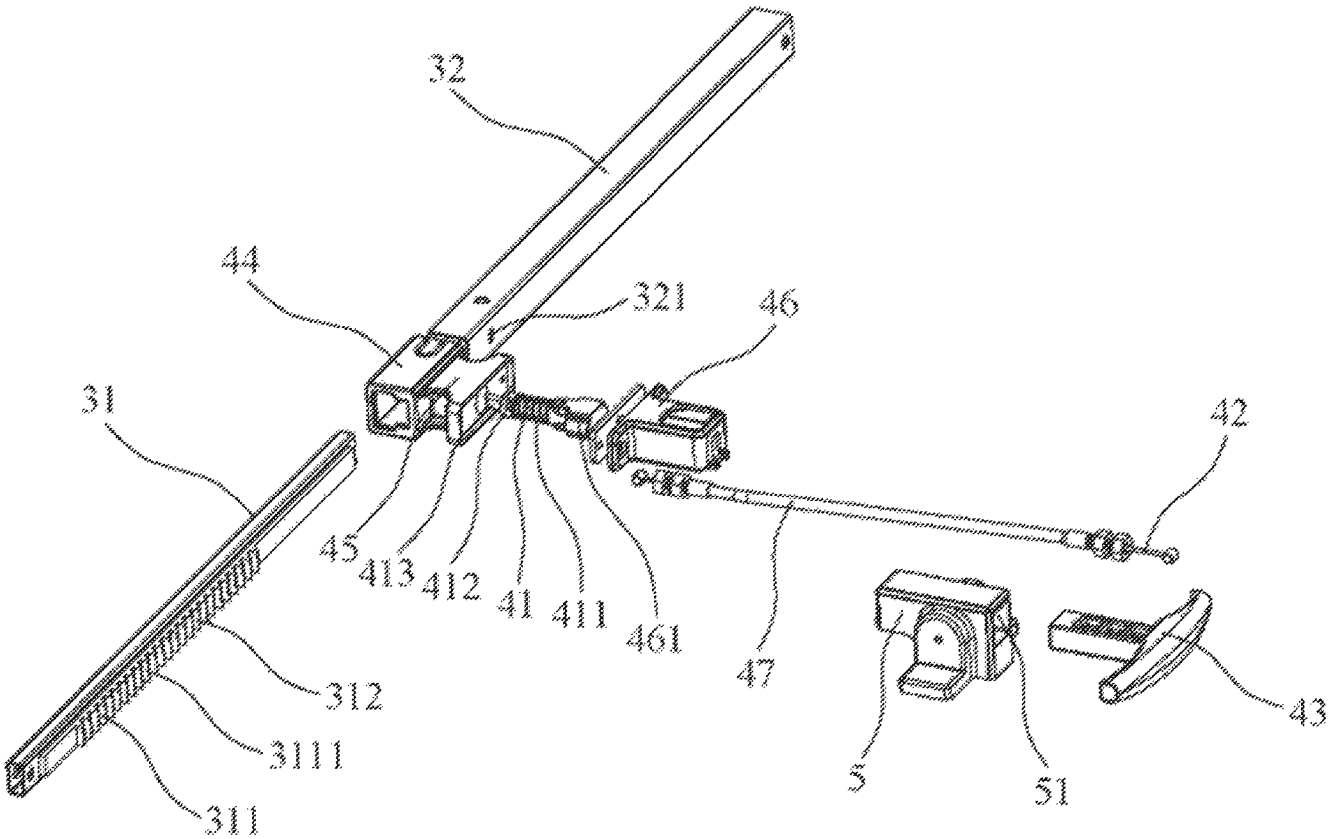
FIG. 3 is a partially exploded view of a height adjustment device according to an exemplary embodiment of the present disclosure.
Figure 4:
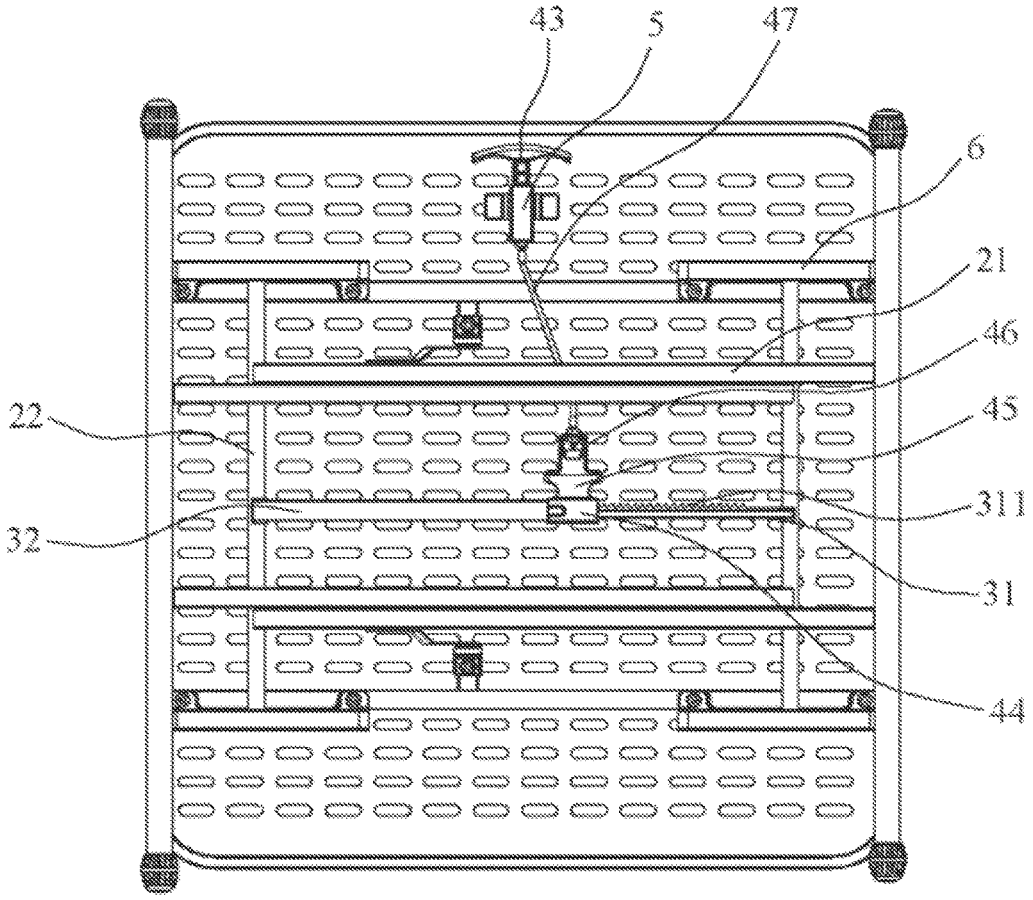
FIG. 4 is a schematic bottom view of a folding table according to an exemplary embodiment of the present disclosure.
Figure 5:
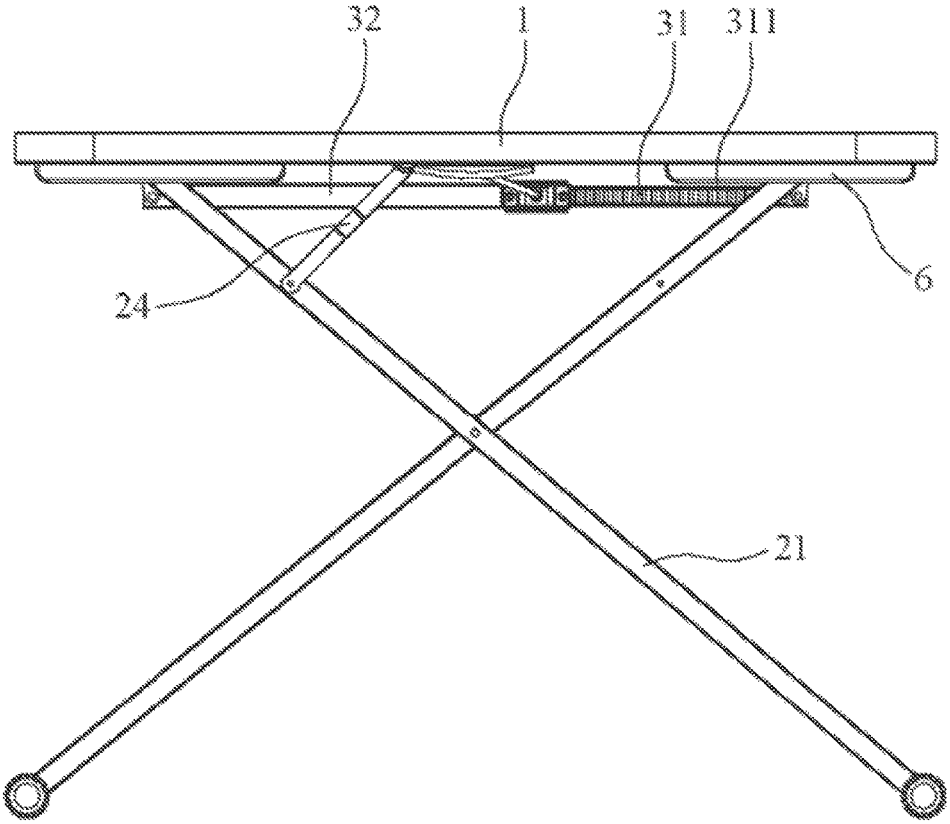
FIG. 5 is a schematic side view of a folding table according to an exemplary embodiment of the present disclosure.
Figure 6:
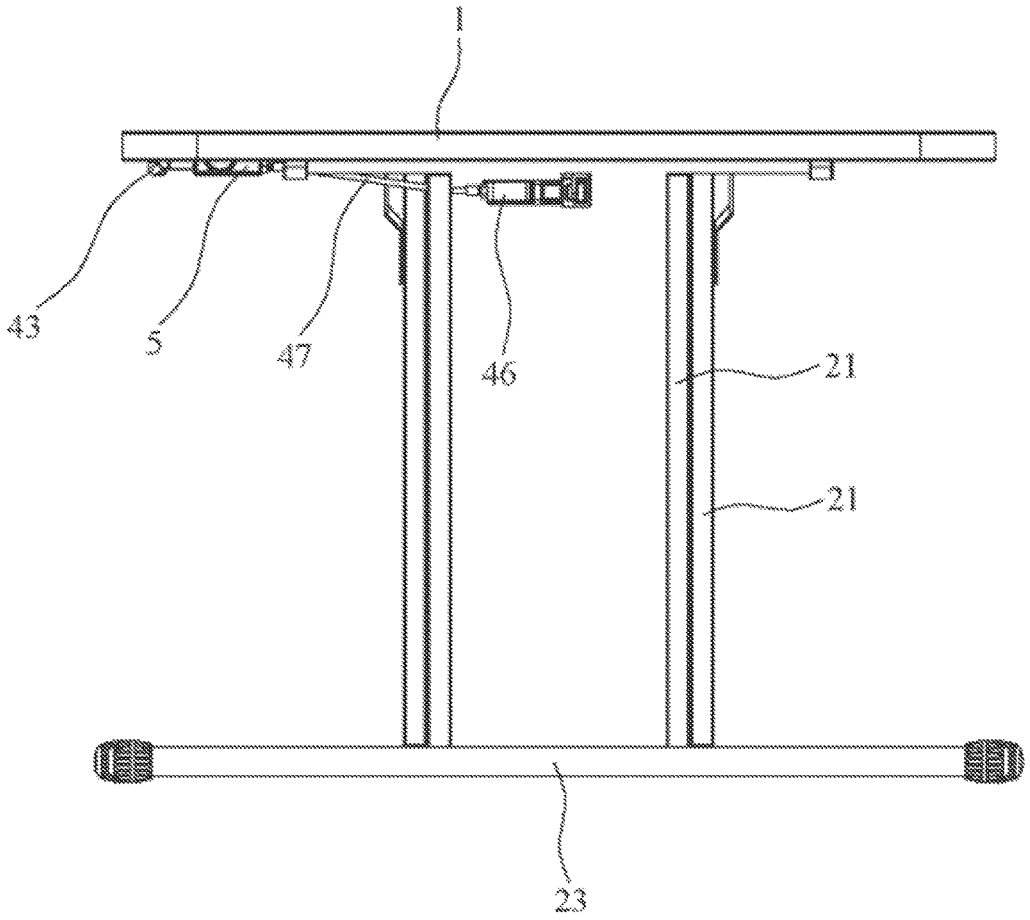
FIG. 6 is another schematic side view of a folding table according to an exemplary embodiment of the present disclosure.

Referring to FIGS. 2, 2A and 3, in some embodiments, a height adjustment device of the present invention comprises an inner sleeve 31 having a first end portion coupled to the connection rod 22 of the first leg 2. The inner sleeve 31 comprises a rack 311 disposed on a side of the inner sleeve 31. In some embodiments, the rack 311 comprises a plurality of engaging slots 312 disposed along a longitudinal direction of the inner sleeve 31. In between each respective engaging slot 312 in the plurality of engaging slots 312 is a tooth 3111. The teeth 3111 are configured to guide the elastic positioning pin 41 into the respective engaging slot 312.

An outer sleeve 32 is movably coupled to the inner sleeve 31 and has a first end portion coupled to the connection rod 22 of the second leg 2. In an embodiment, the outer sleeve 32 further comprises a first hole 321 on a peripheral wall thereof.

An elastic positioning pin 41 is coupled with the outer sleeve 32 and configured to selectively engage with a respective engaging slot 312 in the plurality of engaging slots 312 of the inner sleeve 31, thereby restraining the inner and outer sleeves, 31 and 32, from moving relative to each other. In some embodiments, the elastic positioning pin 41 is disposed on an external side of the outer sleeve 32. The elastic positioning pin 41 is configured to pass through the first hole 321 of the outer sleeve 32 to selectively engage with a respective engaging slot 312 in the plurality of engaging slots 312 of the inner sleeve 31. As such, the elastic positioning pin 41 restrains the inner and outer sleeves, 31 and 32, from moving relative to each other.

Further, a cord 42 is configured to disengage the elastic positioning pin 41 from the inner and/or outer sleeves, 31 and 32, and thus to allow an adjustment of a distance between the connection rods 22 of the first and second legs 2, and thereby an adjustment of a height of the table top 1. In some embodiments, the cord 42 has a first end portion coupled to a rear end portion of the elastic positioning pin 41. The cord 42 is configured to pull the elastic positioning pin 41 outwardly to disengage the elastic positioning pin 41 from the respective engaging slot 312, thereby allowing an adjustment of a distance between the connection rods 22 of the first and second legs 2, and thereby an adjustment of a height of the table top 1.

In some embodiments, a handle 43 is coupled to the cord, e.g., disposed at a second end portion of the cord 42, and configured to facilitate easy pulling of the cord. In an embodiment, the handle 43 is movably or removably coupled to the bottom surface of the table top 1. The cord 42 and the handle 43 are configured to allow the elastic positioning pin 41 to be pulled outwardly to disengage the elastic positioning pin 41 from the respective engaging slot 312, thereby allowing the adjustment of a distance between the connection rods 22 of the first and second legs 2, and thereby the adjustment of a height of the table top 1.

In some embodiments, a connection sleeve 44 is disposed externally on the outer sleeve 32 at a position corresponding to the first hole 321. A first connector 45 is coupled to, or formed with, the connection sleeve 44 at an external side of the connection sleeve 44. The first connector 45 comprises a cavity which is configured to accommodate the elastic positioning pin 41. For example, in an embodiment, the cavity of the first connector 45 is aligned and connected with the first hole 321 of the outer sleeve 32. A reset spring 411 sleeves the elastic positioning pin 41 and is configured to abut an interior surface of the first connector 45. When the pulling of the elastic positioning pin 41 is released, the reset spring 411 forces the elastic positioning pin 41 to engage with the respective engaging slot 312 in the plurality of engaging slots 312.

In some embodiments, the elastic positioning pin 41 comprises a stopper 412. The stopper 412 is disposed between a front end portion and the rear end portion of the elastic positioning pin 41 and configured to abut the first connector 45, thereby preventing the rear end portion of the elastic positioning pin 41 from being inserted into the inner sleeve 31.

In some embodiments, the front end portion, e.g., a positioning end portion 413, of the elastic positioning pin 41 is formed with a curved surface. The positioning end portion 413 is formed with a curved surface to allow for easy insertion and withdrawal of the elastic positioning pin 41 from the respective engaging slot 312.

In some embodiments, a second connector 46 is coupled to the first connector 45 at an opposite side of the first connector 45 with respect to the connection sleeve 44. The elastic positioning pin 41 further comprises a limiting block 461 at the rear end portion of the elastic positioning pin 41. The limiting block 461 is disposed in the second connector 46, coupled to the first end of the cord 42, and formed in such a way that a distance of which the limiting block 461 is to be pulled backwards within the second connector 46 is greater than a length of the front end portion of the elastic positioning pin 41.

The cord can be made of any suitable material. In some embodiments, the cord 42 is made of a material selected from the group comprising metal, rope, and plastic. In some embodiments, the cord 42 is surrounded by a tube 47.

In some embodiments, a connecting seat 5 is disposed on the bottom surface of the table top 1. The connecting seat 5 is configured to accommodate the handle 43. In an embodiment, the connecting seat 5 comprises a chute 51 to guide the handle 43.

Accordingly, height adjustment devices for folding tables and a folding table having such height adjustment devices of the present invention provide a more diverse and flexible height adjustment range with a minimum space requirement for the handle.

For convenience in explanation and accurate definition in the appended claims, the terms "upper", "lower", "up", "down", "upwards", "downwards", "inner", "outer", "inside", "outside", "inwardly", "outwardly", "interior", "exterior", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A height adjustment device for a folding table, wherein the folding table comprises a table top, a first leg, and a second leg, wherein each of the first and second legs comprises a connection rod movably coupled to a bottom surface of the table top, and wherein the first and second legs are crosswise pivotally connected to each other, the height adjustment device comprising:

an inner sleeve having a first end portion coupled to the connection rod of the first leg, the inner sleeve comprising a rack disposed on a side of the inner sleeve, wherein the rack comprises a plurality of engaging slots disposed along a longitudinal direction of the inner sleeve;

an outer sleeve movably coupled to the inner sleeve and having a first end portion coupled to the connection rod of the second leg, the outer sleeve comprising a first hole on a peripheral wall thereof;

an elastic positioning pin disposed on an external side of the outer sleeve and configured to pass through the first hole of the outer sleeve to selectively engage with a respective engaging slot in the plurality of engaging slots of the inner sleeve, thereby restraining the inner and outer sleeves from moving relative to each other; and a cord having a first end portion coupled to a rear end portion of the elastic positioning pin and configured to pull the elastic positioning pin outward to disengage the elastic positioning pin from the respective engaging slot, thereby allowing adjustment of a distance between the connection rods of the first and second legs and thereby adjustment of a height of the table top.

2. The height adjustment device of claim 1, further comprising:

a handle disposed at a second end portion of the cord to facilitate easy pulling of the elastic positioning pin, wherein the handle is movably or removably coupled to the bottom surface of the table top.

3. The height adjustment device of claim 2, further comprising a connecting seat disposed on the bottom surface of the table top and configured to accommodate the handle, wherein the connecting seat comprises a chute configured to guide the handle.

4. The height adjustment device of claim 1, further comprising:

a connection sleeve disposed externally on the outer sleeve at a position corresponding to the first hole;

a first connector coupled to or formed with the connection sleeve at an external side of the connection sleeve, the first connector comprising a cavity to accommodate the elastic positioning pin, wherein the cavity of the first connector is aligned and connected with the first hole of the outer sleeve; and a reset spring sleeving the elastic positioning pin and abutting an interior surface of the first connector, wherein when the pulling of the elastic positioning pin is released, the reset spring forces the elastic positioning pin to engage the respective engaging slot in the plurality of engaging slots.

5. The height adjustment device of claim 4, wherein the elastic positioning pin comprises a stopper disposed between a front end portion and the rear end portion of the elastic positioning pin and configured to abut the first connector, thereby preventing the rear end portion of the elastic positioning pin from inserting into the inner sleeve.

6. The height adjustment device of claim 5, further comprising:

a second connector coupled to the first connector at an opposite side of the first connector with respect to the connection sleeve, wherein the elastic positioning pin further comprises a limiting block at the rear end portion of the elastic positioning pin, disposed in the second connector and coupled to the first end of the cord, and wherein a distance of which the limiting block is to be pulled backwards within the second connector is greater than a length of the front end portion of the elastic positioning pin.

7. The height adjustment device of claim 1, wherein the cord is made of a material selected from the group comprising metal, rope and plastic.

8. The height adjustment device of claim 1, wherein the cord is surrounded by a tube.

9. A height adjustment device for a folding table, wherein the folding table comprises a table top, a first leg, and a second leg, wherein each of the first and second legs comprises a connection rod movably coupled to a bottom surface of the table top, and wherein the first and second legs are crosswise pivotally connected to each other, the height adjustment device comprising:

an inner sleeve having a first end portion coupled to the connection rod of the first leg, the inner sleeve comprising a rack disposed on a side of the inner sleeve, wherein the rack comprises a plurality of engaging slots disposed along a longitudinal direction of the inner sleeve;

an outer sleeve movably coupled to the inner sleeve and having a first end portion coupled to the connection rod of the second leg;

an elastic positioning pin coupled with the outer sleeve and configured to selectively engage with a respective engaging slot in the plurality of engaging slots of the inner sleeve, thereby restraining the inner and outer sleeves from moving relative to each other; and a cord having a first end portion coupled to a rear end portion of the elastic positioning pin; and a handle coupled to a second end portion of the cord, and movably or removably coupled to the bottom surface of the table top, wherein the cord and the handle allows to pull the elastic positioning pin outward to disengage the elastic positioning pin from the respective engaging slot, thereby allowing adjustment of a distance between the connection rods of the first and second legs and thereby adjustment of a height of the table top.

10. A folding table comprising:

a table top;

a first leg and a second leg, wherein each of the first and second legs comprises a connection rod movably coupled to a bottom surface of the table top, and wherein the first and second legs are crosswise pivotally connected to each other; and a height adjustment device comprising:

an inner sleeve having a first end portion coupled to the connection rod of the first leg, the inner sleeve comprising a rack disposed on a side of the inner sleeve, wherein the rack comprises a plurality of engaging slots disposed along a longitudinal direction of the inner sleeve;

an outer sleeve movably coupled to the inner sleeve and having a first end portion coupled to the connection rod of the second leg;

an elastic positioning pin disposed on an external side of the outer sleeve and configured to selectively engage with a respective engaging slot in the plurality of engaging slots of the inner sleeve, thereby restraining the inner and outer sleeves from moving relative to each other; and a cord having a first end portion coupled to a rear end portion of the elastic positioning pin; and a handle coupled to a second end portion of the cord, and movably or removably coupled to the bottom surface of the table top, wherein the cord and the handle allows to pull the elastic positioning pin outward to disengage the elastic positioning pin from the respective engaging slot, thereby allowing adjustment of a distance between the connection rods of the first and second legs and thereby adjustment of a height of the table top.

11. The folding table of claim 10, wherein the outer sleeve comprises a first hole on a peripheral wall thereof, wherein the elastic positioning pin is configured to pass through the first hole of the outer sleeve to selectively engage with the respective engaging slot in the plurality of engaging slots of the inner sleeve.

12. The folding table of claim 10, wherein the height adjustment device further comprises:

a connection sleeve disposed externally on the outer sleeve at a position corresponding to the first hole;

a first connector coupled to or formed with the connection sleeve at an external side of the connection sleeve, the first connector comprising a cavity to accommodate the elastic positioning pin, wherein the cavity of the first connector is aligned and connected with the first hole of the outer sleeve; and a reset spring sleeving the elastic positioning pin and abutting an interior surface of the first connector, wherein when the pulling of the elastic positioning pin is released, the reset spring forces the elastic positioning pin to engage the respective engaging slot in the plurality of engaging slots.

13. The folding table of claim 12, wherein the elastic positioning pin comprises a stopper disposed between a front end portion and the rear end portion of the elastic positioning pin and configured to abut the first connector, thereby preventing the rear end portion of the elastic positioning pin from inserting into the inner sleeve.

14. The folding table of claim 13, wherein the height adjustment device further comprises:

a second connector coupled to the first connector at an opposite side of the first connector with respect to the connection sleeve, wherein the elastic positioning pin further comprises a limiting block at the rear end portion of the elastic positioning pin, disposed in the second connector and coupled to the first end of the cord, and wherein a distance of which the limiting block is to be pulled backwards within the second connector is greater than a length of the front end portion of the elastic positioning pin.

15. The folding table of claim 10, wherein the height adjustment device further comprises a connecting seat disposed on the bottom surface of the table top and configured to accommodate the handle, wherein the connecting seat comprises a chute configured to guide the handle.

16. The folding table of claim 10, wherein each of the first and second legs comprises a first support rod and a second support rod parallel to the first support rod.

17. The folding table of claim 16, wherein each of the first and second legs further comprises a cross rod coupled to each of the first and second support rods, wherein the cross rods abut a ground when the folding table is in use, thereby supporting the folding table.

18. The folding table of claim 10, wherein a sliding seat is disposed on the bottom surface of the table top coupling an end portion of the connection rod to the bottom surface of the table top, and the end portion of the connection rod is slidable within the sliding seat.

19. The folding table of claim 18, wherein the sliding seat is integrally formed with the bottom surface of the table top.

20. The folding table of claim 10, wherein an auxiliary support rod is disposed between a respective leg of the first and second legs and the bottom surface of the table top, wherein a first end of the auxiliary support rod is pivotally coupled to the respective leg and a second end of the auxiliary support rod is pivotally coupled to a connection member on the bottom surface of the table top.

* * * * *